US005533924A

United States Patent [19]

Stroupe et al.

[11] Patent Number: 5,533,924

[45] Date of Patent: Jul. 9, 1996

[54] POLISHING APPARATUS, A POLISHING WAFER CARRIER APPARATUS, A REPLACABLE COMPONENT FOR A PARTICULAR POLISHING APPARATUS AND A PROCESS OF POLISHING WAFERS

[75] Inventors: Hugh Stroupe; Sujit Sharan; Gurtej S. Sandhu, all of Boise, Id.

[73] Assignee: Micron Technology, Inc., Boise, Id.

[21] Appl. No.: 299,506

[22] Filed: Sep. 1, 1994

[51] Int. Cl.[6] ..... B24B 5/00

[52] U.S. Cl. ..... 451/286; 451/41

[58] Field of Search ..... 451/384, 388, 451/390, 397, 398, 402, 285, 287, 288, 289–291, 286, 41; 269/21, 287

[56] References Cited

U.S. PATENT DOCUMENTS

| | | | |
|---|---|---|---|
| 3,374,582 | 3/1968 | Boettcher | 451/286 |
| 3,453,783 | 7/1969 | Queen | 451/286 |
| 4,753,049 | 6/1988 | Mori | 451/289 |
| 5,216,843 | 6/1993 | Breivogel et al. | 451/287 |

FOREIGN PATENT DOCUMENTS

| | | | |
|---|---|---|---|
| 0141444 | 7/1985 | Japan | 269/21 |

*Primary Examiner*—Bruce M. Kisliuk
*Assistant Examiner*—Andrew Weinberg
*Attorney, Agent, or Firm*—Wells, St. John, Roberts, Gregory & Matkin

[57] ABSTRACT

A wafer polishing apparatus includes: a) a rotatable polishing platen; b) a polishing pad received outwardly of the polishing platen; c) a wafer carrier head, the wafer carrier head being mounted for selective rotation relative to the polishing platen; the wafer carrier head including a wafer carrier apparatus for use in polishing a semiconductor wafer having a particular orientation edge discontinuity shape, the wafer carrier apparatus including, i) a base support mounted to rotate with the carrier head; and ii) a wafer carrier ring separately rotatably received relative to the base support, the wafer carrier ring having an internal periphery which is sized and shaped to receive the particular semiconductor wafer for which the apparatus is adapted, the wafer carrier ring internal periphery including a portion which is sized and shaped to mate with the particular orientation edge discontinuity shape. A polishing process is also disclosed using this and other apparatus.

23 Claims, 5 Drawing Sheets

POLISHING APPARATUS, A POLISHING WAFER CARRIER APPARATUS, A REPLACABLE COMPONENT FOR A PARTICULAR POLISHING APPARATUS AND A PROCESS OF POLISHING WAFERS

TECHNICAL FIELD

This invention relates to the polishing of semiconductor wafers, and to equipment therefor.

BACKGROUND OF THE INVENTION

Present semiconductor wafers are generally circular in shape, and have one or more "flats" along their edge or periphery. The flats serve at least two purposes. First, the number and orientation of flats relative to one another indicates whether a given wafer has been inherently doped with a p-type or an n-type conductivity impurity. Second, the position of the flats is of critical importance for proper wafer alignment for the various processing steps conducted upon the wafer. Each deposition or treatment of a wafer must be specifically conducted relative to previous processing steps and wafer orientation. The flats are utilized to precisely orient the wafer in given separate processing steps to assure the most precise wafer configuration. In the context of this document, wafer flats are generically referred to as defining an orientation edge discontinuity shape. Orientation edge discontinuity includes other shapes of, for example, a general male or female configuration. A wafer flat is considered as a female configuration, as wafer edge material has been removed to provide an indentation relative to the normal circular circumference of the wafer. Other female indentations, for example V-shaped or box-shaped, might be utilized. Additionally, male projections from the circumferential edge also would constitute an orientation edge discontinuity. In the context of this document, "orientation edge discontinuity" is intended to define any peripheral exterior irregularity in shape which enables precise alignment of the wafer relative to various semiconductor processing equipment.

In semiconductor wafer processing, one common step conducted is polishing of the exposed wafer surface prior to subsequent deposition or other processing steps. This is typically accomplished to provide outer surface planarity, and also to provide electrical isolation between devices by removal of outer conductive material. One type of processing finding increasing use is chemical-mechanical polishing (CMP). A wafer carrier portion of the prior art chemical-mechanical polisher is described with reference to FIG. 1. Such constitutes an underside view of a wafer polisher apparatus indicated generally with reference numeral 10. Carrier apparatus 10 is comprised of a wafer carrier ring 12 which internally retains a wafer 14 which will be polished. Wafer 14 has an outer surface 20 which will be polished. A series of bolt holes 16 receive bolts (not shown) for mounting ring 12 to a backing plate and ultimately to a rotatable drive mechanism. The mechanism would engage ring 12 from behind and perpendicularly relative to the plane of the paper upon which FIG. 1 lies. Wafer 14 is indicated as having a particular orientation edge discontinuity shape provided by a singular female flat edge portion 18. Carrier 12 and wafer 18 would be rotatably pressed against a polishing platen (not shown) having a polishing pad supported thereatop. Ring 12 and wafer 18 would be caused to rotate, with the platen also being rotated, to produce the desired polishing action against wafer surface 20.

One goal in chemical-mechanical polishing and in other polishing is typically to produce a wafer which is substantially uniformly flat across the wafer surface. Unfortunately in chemical-mechanical polishing utilizing the FIG. 1 apparatus, this overall objective is often difficult to achieve. Typically, the portion of surface 20 being polished which is adjacent flat 18 polishes at a faster rate, and accordingly more material is removed in these locations for a given polishing step than are other portions of the wafer. The exact reasons for this phenomena are not fully understood. However, it is theorized that the polishing pad perhaps dips or extends into the illustrated open area 22 during polishing. This might result in more bearing force or polishing action against those portions of the wafer adjacent flat 18 than on other portions of surface 20.

It would be desirable to overcome these and perhaps other problems associated in wafer polishing. Although the principal motivation for this invention resulted from problems associated with chemical-mechanical polishing of semiconductor wafers, the artisan will appreciate that aspects of the invention have applicability to other wafer polishing processes and apparatus. The invention is intended to be limited only by the accompanying claims appropriately interpreted in accordance with the Doctrine of Equivalents.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, a process of polishing a semiconductor wafer having an orientation edge discontinuity shape comprises the following steps:

positioning a wafer to be polished within a polishing head of a wafer polishing apparatus, the polishing head and wafer cooperatively radially filling an edge void in the wafer created by the wafer edge discontinuity shape;

rotating the polishing platen relative to the polishing head;

rotating the polishing head with the wafer received thereon relative to the polishing platen;

positioning the rotating polishing head in juxtaposition to the rotating polishing platen to bear the wafer against the polishing platen to polishing the wafer; and during polishing, allowing limited rotational movement of the wafer within and relative to the polishing head.

In accordance with another aspect of the invention, a wafer polishing apparatus comprises:

a rotatable polishing platen;

a polishing pad received outwardly of the polishing platen;

a wafer carrier head, the wafer carrier head being mounted for selective rotation relative to the polishing platen; the wafer carrier head including a wafer carrier apparatus for use in polishing a semiconductor wafer having a particular orientation edge discontinuity shape, the wafer carrier apparatus comprising:

a base support mounted to rotate with the carrier head; and a wafer carrier ring separately rotatably received relative to the base support, the wafer carrier ring having an internal periphery which is sized and shaped to receive the particular semiconductor wafer for which the apparatus is adapted, the wafer carrier ring internal periphery including a portion which is sized and shaped to mate with the particular orientation edge discontinuity shape.

In accordance with still a further aspect of the invention, a replaceable component for a wafer polishing apparatus comprises:

a wafer carrier ring sized and shaped to be rotatably received relative to the base support, the wafer carrier ring having an internal periphery which is sized and shaped to receive the semiconductor wafer for which the apparatus is adapted, the wafer carrier ring internal periphery including a portion which is sized and shaped to mate with the particular orientation edge discontinuity shape.

Figure 8:
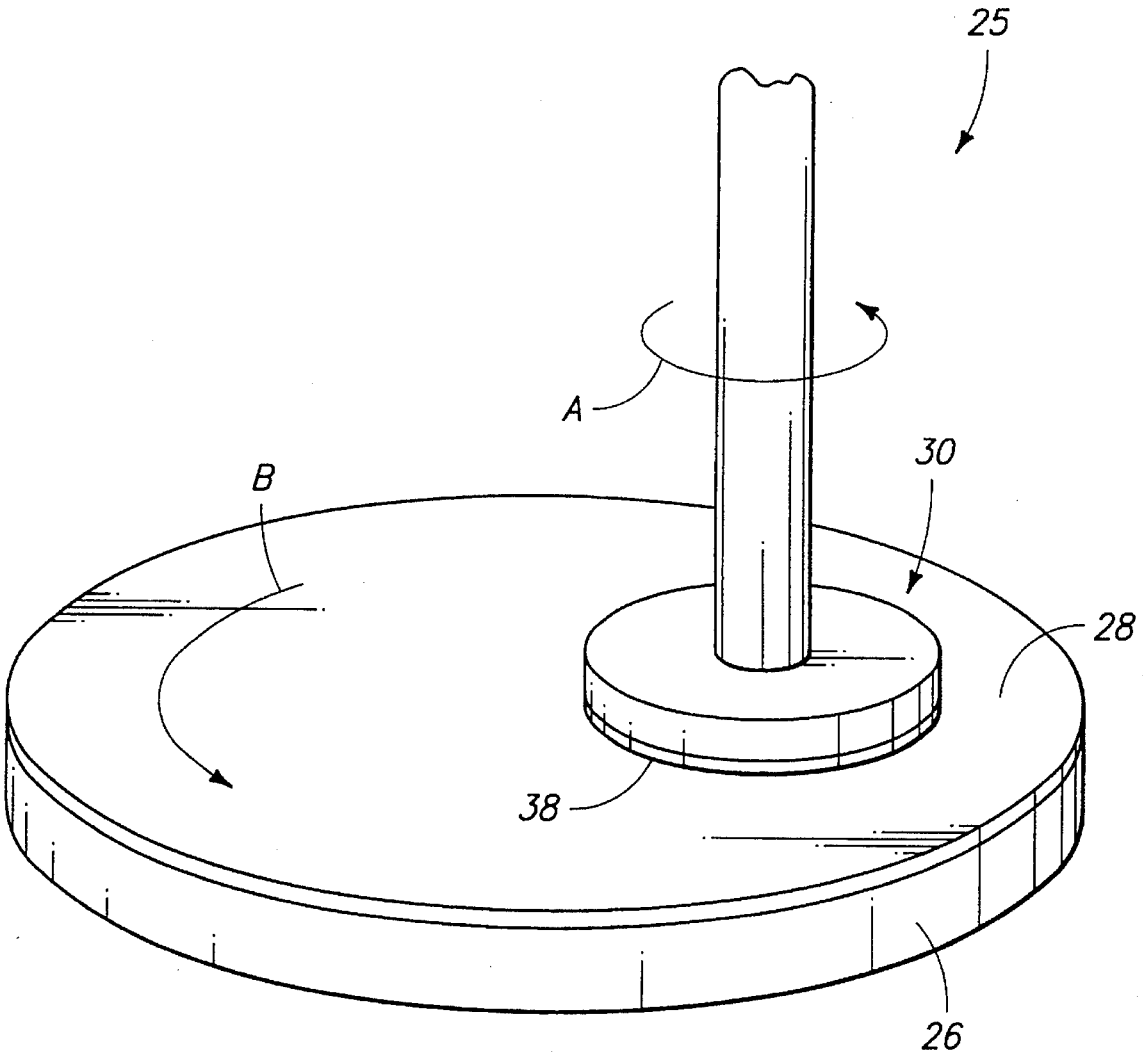
FIG. 8 is a diagrammatic perspective view of a wafer polishing apparatus in accordance with one aspect of the invention.

More particularly and with reference to FIGS. 2–8, a wafer polishing apparatus is indicated generally with reference numeral 25 (FIG. 8). Such is comprised of a rotatably driven polishing platen 26 having a polishing pad 28 received outwardly thereof. A wafer carrier head 30 supports a wafer 32 (FIG. 2) for polishing. Wafer 32 has an outer surface 36 which will be polished. Wafer carrier head 30 is driven, for example, in a rotation direction "A", while platen 26 is also caused to be driven in the same rotation direction "B".

Figure 2:
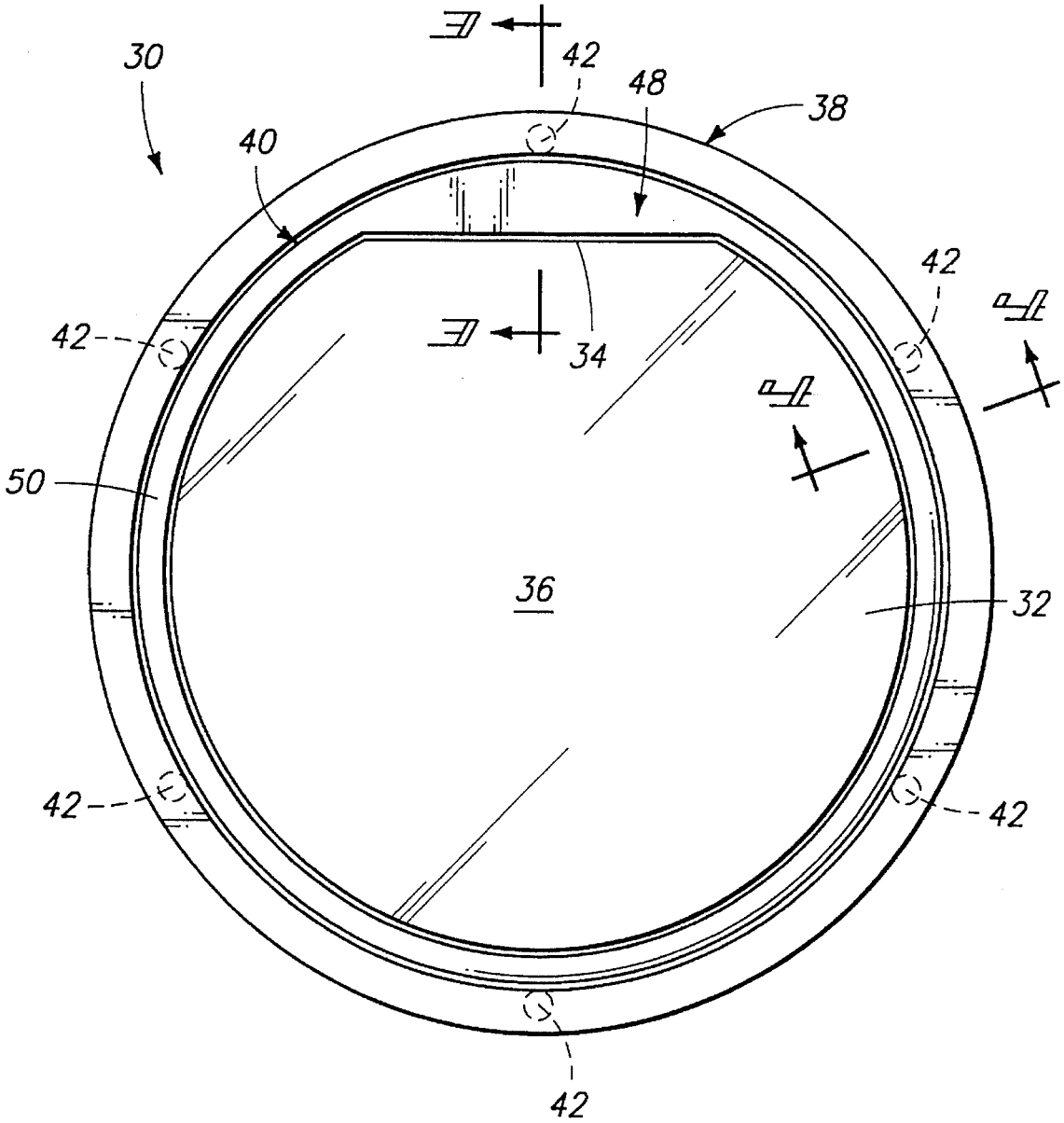
FIG. 2 is a diagrammatic bottom or upwardly-looking view of a wafer polishing carrier apparatus in accordance with one aspect of the invention.

Wafer carrier apparatus 25, and more particularly wafer carrier head 30, is adapted for polishing semiconductor wafers having a particular orientation edge discontinuity shape. Referring to FIGS. 2–7, the particular edge discontinuity shape shown is for a 6-inch wafer 32 having a singular edge flat 34 (FIG. 2).

Wafer carrier head 30 constitutes a wafer carrier apparatus principally comprising a base support. In the preferred embodiment, the base support is in the form of a support ring 38 and a back plate 31. Support ring 38 would preferably be conventionally mounted to rotate as part of the carrier head via mounting attachment bolts (not shown). These would extend through the illustrated holes 33 in back plate 31 and thread into a series of threaded bolt holes 42 in support ring 38. Support ring 38 internally supports a wafer retaining pad 44 against back plate 31. (FIGS. 3 and 4) Pad 44 preferably comprises a polyurethane, suede-coat on a non-woven or mylar substrate with adhesive backing. The intended purpose of pad 44 is to grip the back of the wafer during rotation. Ideally, it would hold the wafer with no slippage. But in reality, the wafer slips as it is rotated against pad 28. Pad 44 has more adhesion to the wafer than pad 28 in order for the wafer to polish.

During loading and unloading, the wafer is held in place with vacuum. When the wafer comes in contact with pad 28, carrier ring 40 and support ring 38 keep the wafer from being pushed out and in practice traps the wafer. Down-force is applied to head 30 and the vacuum is then turned off. The wafer is now trapped between pad 28 (with polishing slurry on it) and pad 44, which is provided with water to increase adhesion. The rotation of back plate 31 is thereby substantially transferred to the wafer through pad 44.

A wafer carrier ring 40 is rotatably received relative to support ring 38 and accordingly relative to back plate 31. Ring 40 has an internal periphery 46 (FIG. 5) which is sized and shaped to receive the particular semiconductor wafer shape for which the apparatus is adapted. Wafer carrier ring internal periphery 46 includes a portion 48 which is sized and shaped to mate with the particular orientation edge discontinuity shape of the wafer.

More particularly, wafer carrier ring 40 comprises an encircling ring portion 50, and internal periphery portion 48 comprises an internal male-like projection 52 extending inwardly therefrom. Male projection 52 thus effectively mates relative to the external edge of wafer 32, such that wafer 32 is non-rotatable relative to wafer carrier ring 40.

Figure 3:
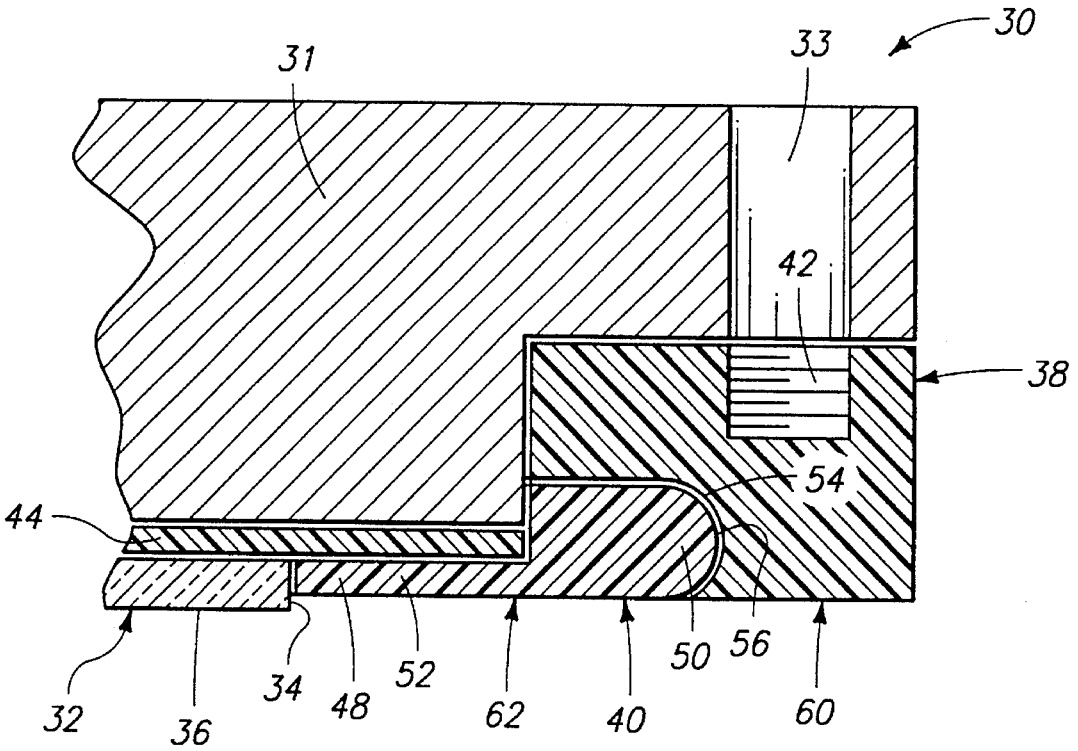
FIG. 3 is an enlarged sectional view taken through line 3—3 in FIG. 2.
Figure 4:
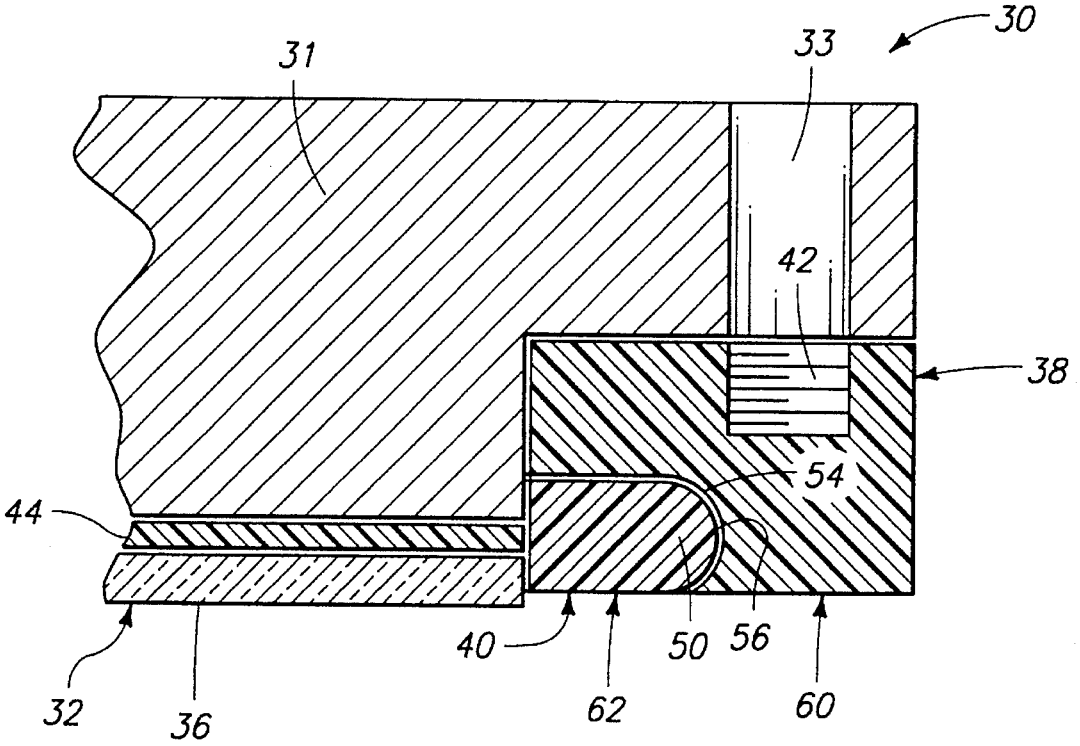
FIG. 4 is an enlarged sectional view taken through line 4—4 in FIG. 2.
Figure 5:
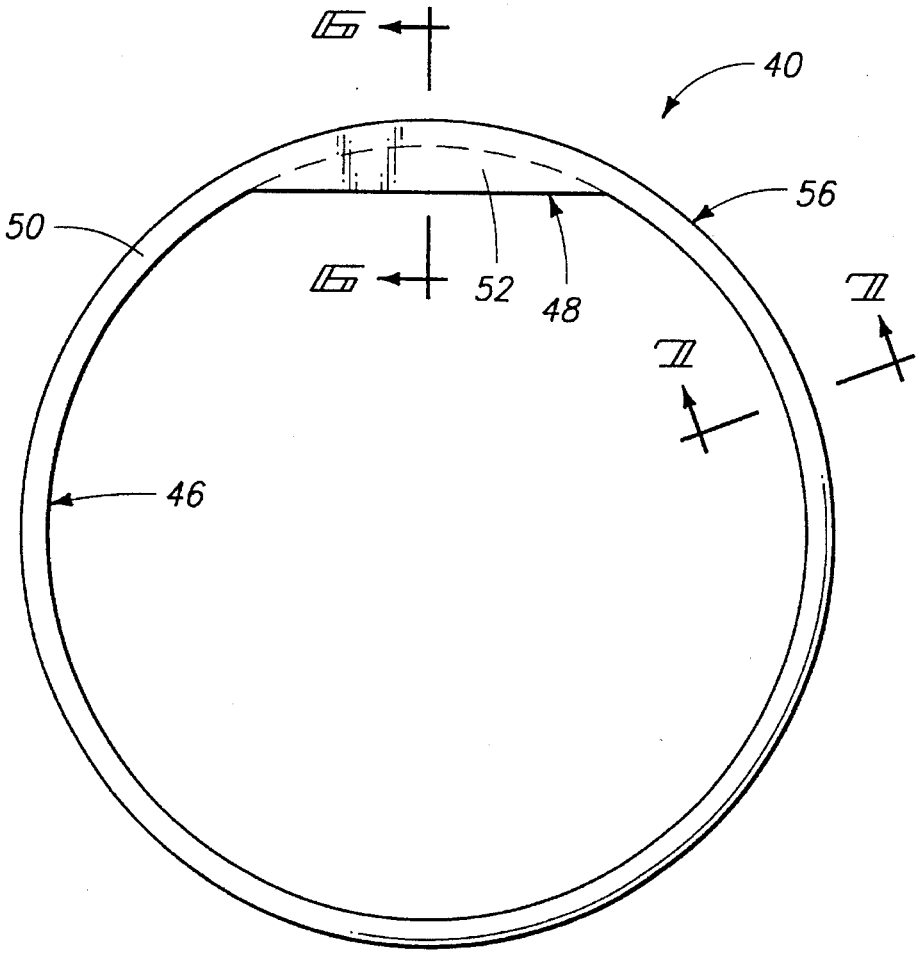
FIG. 5 is a bottom or upwardly-looking view of a replaceable wafer carrier ring component of the FIG. 2 apparatus in accordance with an aspect of the invention.
Figure 6:
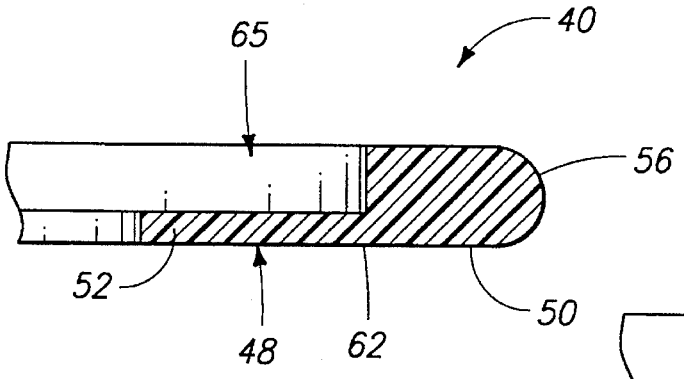
FIG. 6 is an enlarged sectional view taken through line 6—6 in FIG. 5.
Figure 7:
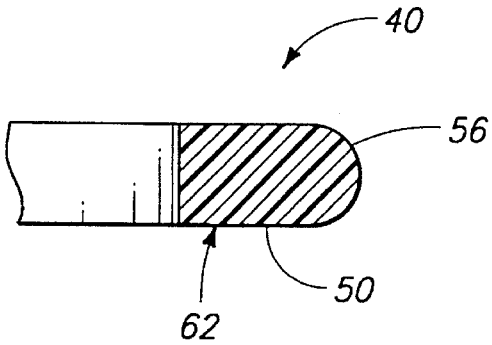
FIG. 7 is an enlarged sectional view taken through line 7—7 in FIG. 5.

Support ring 38 comprises an internal periphery having a circumferential groove 54 provided therein (FIGS. 3 and 4). Wafer carrier ring 40 likewise has an external periphery 56 which is removably snap-fit within support ring groove 54. In such manner, wafer carrier ring 40 is circumferentially slidable, and thereby rotatable, relative to support ring 38. A preferred material of construction for support ring 38 and wafer carrier ring 40 is polytetrafluoroethylene filled acetal resin. The illustrated relationship provides but one example of a preferred slidable male-female interconnecting fit between wafer carrier ring 40 and support ring 38. Encircling ring portion 50 and internal male projection 52 of wafer carrier ring 40 have different respective axial thicknesses. The axial thickness of male projection 52 is less than the axial thickness of encircling ring portion 50, thereby forming an axial recess 65 (FIG. 6). Internal wafer retaining pad 44 is received within axial recess 65 (FIG. 3).

Support ring 38 and wafer carrier ring 40 have outer axial polish exposed surfaces 60 and 62, respectively. Such axial surfaces are flush with one another. Wafer 32 is received relative to apparatus 30 such that wafer outer exposed surface 36 is polished, and surfaces 60 and 62 are substantially precluded from being polished.

Wafer carrier ring 40 constitutes a separate and replaceable component that can be replaced upon wear, or exchanged to provide a different internal peripheral shape for accommodating differently shaped wafers. For example, multiple or different shaped male projections 52 might be provided to accommodate a two or more flatted wafer. Other relative projections or indentations could also be provided to accommodate to any desired wafer shape.

In accordance with the invention, wafer 32 to be polished is positioned within apparatus 30 with male projection 52 cooperatively radially filling the edge void created by wafer flat 34. Polishing platen 26 is caused to rotate relative to head apparatus 30. Polishing head apparatus 30 is caused to rotate relative to polishing platen 26. Components 30 and 28 are positioned in juxtaposition relative to one another to bear wafer surface 36 of wafer 32 against the pad 28 of polishing platen 26 for polishing the wafer. During polishing, limited rotational movement of wafer 32 within and relative to polishing head 30 is provided by the sliding rotational engagement of wafer carrier ring 40 within circumferential support ring 38.

Ultimate limited rotational movement of wafer 32 relative to rotating polishing head 30 is highly desirable. Much less desired would be unlimited rotational movement of wafer 32, as it is rotational movement of the platen relative to the wafer surface which provides a significant portion of the fundamental polishing action against wafer surface 36. However, some limited rotational movement of wafer 32 during a polishing is desired. In the preferred embodiment, such rotational movement might only be 10° to 20° during an entire 30-minute wafer polishing process. Friction of the back (not shown) of wafer 32 against pad 44 by frictional pressing forces is intended to preclude significant free rotation, as well as a limited interference fit of wafer carrier ring 40 relative to support ring 38.

In reducing the apparatus aspects of the invention to practice, designs were created wherein the illustrated wafer orientation edge discontinuity was completely radially filled, but wafer 32 was precluded from any rotation whatsoever relative to the wafer carrier head 30. In approximately 1 out of 3 wafers being polished with such an apparatus, the wafers were being destroyed. Apparently, pressure points where the wafer flat meets the round circumference were sufficiently great, the result of preclusion of wafer rotation, that wafer cracks developed at these points resulting in wafer destruction or fracturing. No such fracturing or wafer destruction was observed utilizing apparatus in accordance with the apparatus aspects of the invention.

Figure 1:
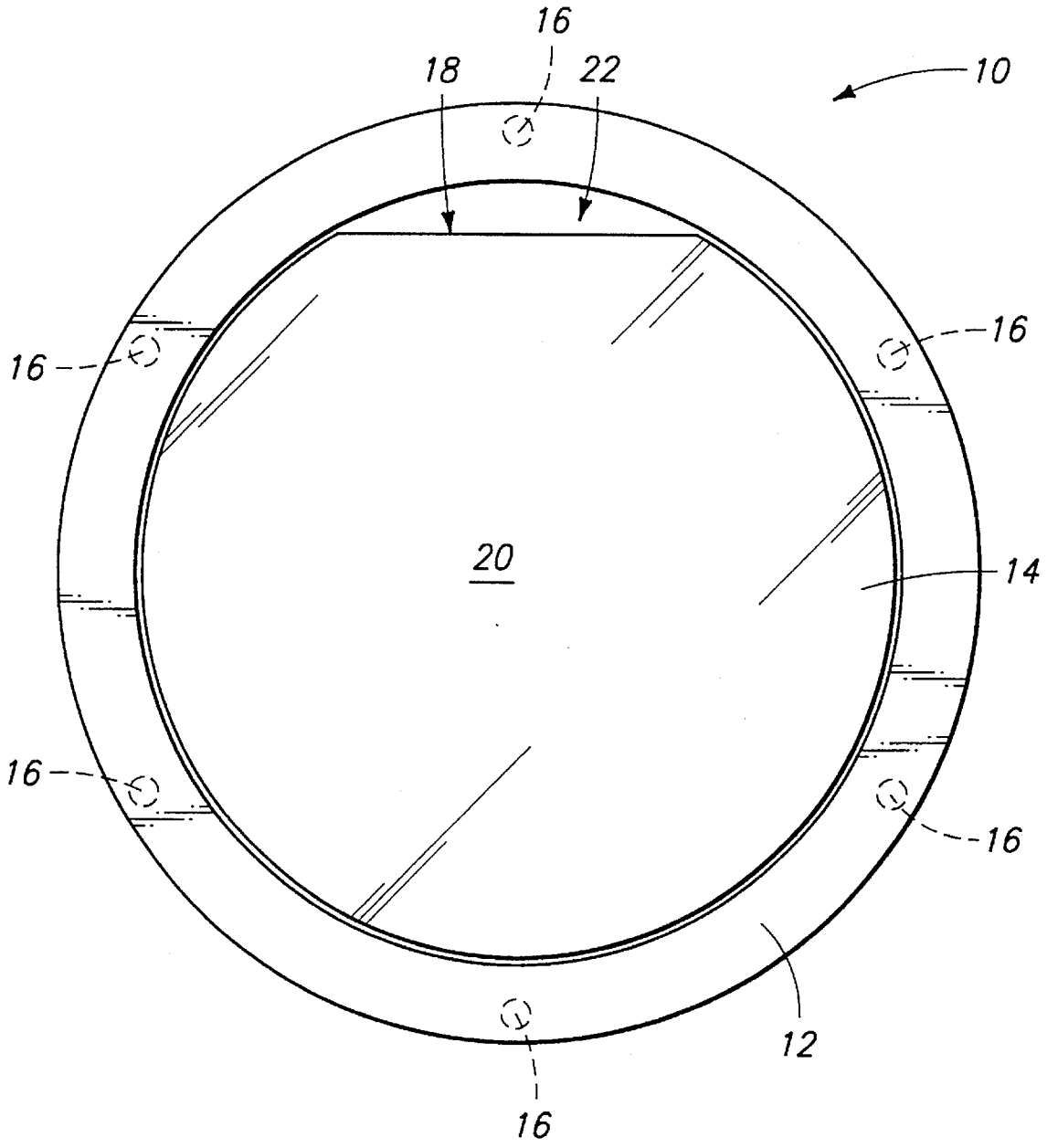
Fig 1 PRIOR ART
FIG. 1 is a diagrammatic bottom or upwardly-looking view of a prior art chemical-mechanical polishing wafer carrier apparatus, and is described in the "Background" section above.

The following data compares wafers processed utilizing apparatus in accordance with the invention versus processing utilizing conventional chemical-mechanical processors, such as that shown by FIG. 1.

| Wafer # | Pre-CMP Thickness | Pre-CMP 1 δ (sigma) (%) | Post-CMP Thickness | Post-CMP 1 δ (sigma) (%) |
|---|---|---|---|---|
| 1 | 25206 | 1.49 | 14824 | 5.06 |
| 2 | 25463 | 1.22 | 14614 | 5.18 |
| 3 | 25369 | 1.67 | 14867 | 4.86 |
| 4 | 25842 | 2.01 | 14900 | 5.53 |
| 5 | 25914 | 1.38 | 14893 | 5.36 |
| 6 | 25555 | 2.11 | 14287 | 8.81 |
| 7 | 25347 | 1.35 | 14613 | 9.03 |
| 8 | 25614 | 1.16 | 14596 | 9.12 |
| 9 | 25922 | 1.43 | 14300 | 10.06 |
| 10 | 25873 | 1.57 | 14112 | 9.56 |

Wafers 1–5 were polished with the wafer polishing carrier apparatus and components of FIGS. 2–8, while wafers 6–10 were polished with the prior art FIG. 1 carrier apparatus. The depicted σ (sigma) is a percentage of thickness uniformity of the outer layer, and is shown for both pre-polishing and post-polishing. The illustrated thicknesses are taken of an average over the entirety of the wafer surface. Sigma reports a difference from average of taking thickness measurements at forty-nine different uniformly displaced locations across the wafer. Post-polishing σ would desirably be as low a number as possible, although it would be inherently higher than pre-polishing σ. Sigma is inherently a measurement of thickness of the outer layer being polished as opposed to overall thickness of the wafer. As the more flatly polished wafer by polishing action results in greater differences and thicknesses across the wafer of the outer layer, post-polishing σ will accordingly be greater than the pre-polishing σ.

As shown by the above data, for essentially the same pre-polishing wafer thickness and pre-polishing σ, considerably lower post-polishing σ percentages are provided for wafers processed utilizing the inventive apparatus of FIG. 2–8 than in using the FIG. 1 apparatus.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A wafer polishing carrier apparatus for use in polishing a semiconductor wafer having a particular orientation edge discontinuity shape, the wafer carrier apparatus comprising:

a base support; and a wafer carrier ring rotatably received relative to the base support, the wafer carrier ring having an internal periphery which is sized and shaped to receive the particular semiconductor wafer shape for which the apparatus is adapted, the wafer carrier ring internal periphery including a portion sized and shaped to mate with the particular orientation edge discontinuity shape.

2. The wafer carrier apparatus of claim 1 comprising a slidable male-female interconnecting fit between the wafer carrier ring and the base support.

3. The wafer carrier apparatus of claim 1 wherein the base support is in the form of a circumferential support ring, the support ring having an internal periphery having a circumferential groove provided therein, the wafer carrier ring having an external periphery which is slidably received within the support ring groove.

4. The wafer carrier apparatus of claim 1 wherein the base support is in the form of a circumferential support ring, the support ring having an internal periphery having a circumferential groove provided therein, the wafer carrier ring having an external periphery which is removably snap-fit within the support ring groove and circumferentially slidable therewithin.

5. The wafer carrier apparatus of claim 1 wherein the wafer carrier ring comprises an encircling ring portion, the internal periphery portion comprising an internal male projection extending inwardly from the encircling ring portion.

6. The wafer carrier apparatus of claim 1 further comprising an internal wafer retaining pad, and wherein the wafer carrier ring comprises an encircling ring portion, the internal periphery portion comprising an internal male projection extending inwardly from the encircling ring portion, the encircling ring porion and internal male projection having different respective axial thicknesses, the axial thickness of the male projection being less than the axial thickness of the encircling ring portion thereby forming an axial recess, the internal wafer retaining pad being received within the recess.

7. The wafer carrier apparatus of claim 1 wherein the base support is in the form of a circumferential support ring, the support ring and the wafer carrier ring having respective outer axial polish exposed surfaces, said outer axial surfaces being flush with one another.

8. The wafer carrier apparatus of claim 1 comprising a slidable male-female interconnecting fit between the wafer carrier ring and the base support; and further comprising:

an internal wafer retaining pad, and wherein the wafer carrier ring comprises an encircling ring portion, the internal periphery portion comprising an internal male projection extending inwardly from the encircling ring portion, the encircling ring portion and internal male projection having different respective axial thicknesses, the axial thickness of the male projection being less than the axial thickness of the encircling ring portion thereby forming an axial recess, the internal wafer retaining pad being received within the recess.

9. The wafer carrier apparatus of claim 1 comprising a slidable male-female interconnecting fit between the wafer carrier ring and the base support, and wherein the wafer carrier ring comprises an encircling ring portion, the internal periphery portion comprising an internal male projection extending inwardly from the encircling ring portion.

10. The wafer carrier apparatus of claim 1 further comprising an internal wafer retaining pad, and wherein the wafer carrier ring comprises an encircling ring portion, the internal periphery portion comprising an internal male projection extending inwardly from the encircling ring portion, the encircling ring porion and internal male projection having different respective axial thicknesses, the axial thickness of the male projection being less than the axial thickness of the encircling ring portion thereby forming an axial recess, the internal wafer retaining pad being received within the recess; and the base support is in the form of a circumferential support ring, the support ring the wafer carrier ring have respective outer axial polish exposed surfaces, said outer axial surfaces being flush with one another.

11. A wafer polishing apparatus comprising:

a rotatable polishing platen;

a polishing pad received outwardly of the polishing platen;

a wafer carrier head, the wafer carrier head being mounted for selective rotation relative to the polishing platen; the wafer carrier head including a wafer carrier apparatus for use in polishing a semiconductor wafer having a particular orientation edge discontinuity shape, the wafer carrier apparatus comprising:

a base support mounted to rotate with the carrier head; and a wafer carrier ring separately rotatably received relative to the base support, the wafer carrier ring having an internal periphery which is sized and shaped to receive the particular semiconductor wafer for which the apparatus is adapted, the wafer carrier ring internal periphery including a portion which is sized and shaped to mate with the particular orientation edge discontinuity shape.

12. The wafer polishing apparatus of claim 11 wherein the wafer carrier apparatus comprises a slidable male-female interconnecting fit between the wafer carrier ring and the base support.

13. The wafer polishing apparatus of claim 11 wherein the wafer carrier apparatus comprises:

the base support being in the form of a circumferential support ring, the support ring having an internal periphery having a circumferential groove provided therein, the wafer carrier ring having an external periphery which is slidably received within the support ring groove.

14. The wafer polishing apparatus of claim 11 wherein the wafer carrier apparatus comprises:

the base support being in the form of a circumferential support ring, the support ring having an internal periphery having a circumferential groove provided therein, the wafer carrier ring having an external periphery which is removably snap-fit within the support ring groove and circumferentially slidable therewithin.

15. The wafer polishing apparatus of claim 11 wherein the wafer carrier apparatus comprises:

the wafer carrier ring having an encircling ring portion, the internal periphery portion comprising an internal male projection extending inwardly from the encircling ring portion.

16. The wafer polishing apparatus of claim 11 wherein the wafer carrier apparatus comprises:

an internal wafer retaining pad; and the wafer carrier ring comprising an encircling ring portion, the internal periphery portion comprising an internal male projection extending inwardly from the encircling ring portion, the encircling ring porion and internal male projection having different respective axial thicknesses, the axial thickness of the male projection being less than the axial thickness of the encircling ring portion thereby forming an axial recess, the internal wafer retaining pad being received within the recess.

17. The wafer polishing apparatus of claim 11 wherein the wafer carrier apparatus comprises:

the base support being in the form of a circumferential support ring, the support ring and the wafer carrier ring having respective outer axial polish exposed surfaces, said outer axial surfaces being flush with one another.

18. The wafer polishing apparatus of claim 11 wherein the wafer carrier apparatus comprises a slidable male-female interconnecting fit between the wafer carrier ring and the base support, the wafer carrier ring having an encircling ring portion, the internal periphery portion comprising an internal male projection extending inwardly from the encircling ring portion.

19. The wafer polishing apparatus of claim 11 wherein the wafer carrier apparatus comprises a slidable male-female interconnecting fit between the wafer carrier ring and the base support; and the wafer carrier apparatus comprises:

an internal wafer retaining pad; and the wafer carrier ring comprising an encircling ring portion, the internal periphery portion comprising an internal male projection extending inwardly from the encircling ring portion, the encircling ring porion and internal male projection having different respective axial thicknesses, the axial thickness of the male projection being less than the axial thickness of the encircling ring portion thereby forming an axial recess, the internal wafer retaining pad being received within the recess.

20. The wafer polishing apparatus of claim 11 wherein the wafer carrier apparatus comprises:

an internal wafer retaining pad; and the wafer carrier ring comprising an encircling ring portion, the internal periphery portion comprising an internal male projection extending inwardly from the encircling ring portion, the encircling ring potion and internal male projection having different respective axial thicknesses, the axial thickness of the male projection being less than the axial thickness of the encircling ring portion thereby forming an axial recess, the internal wafer retaining pad being received within the recess; and the base support is in the form of a circumferential support ring, the support ring and the wafer carrier ring have respective outer axial polish exposed surfaces, said outer axial surfaces being flush with one another.

21. A replaceable component for a wafer polishing apparatus, the polishing apparatus having a rotatable polishing platen, a polishing pad received atop the polishing platen, and a wafer carrier head; the wafer carrier head being mounted for selective rotation independent of the polishing platen; the wafer carrier head including a wafer carrier apparatus for use in polishing a semiconductor wafer having a particular orientation edge discontinuity shape, the wafer carrier apparatus comprising a base support mounted to rotate with the wafer carrier head; the replaceable component comprising:

a wafer carrier ring sized and shaped to be rotatably received relative to the base support, the wafer carrier ring having an internal periphery which is sized and shaped to receive the semiconductor wafer for which the apparatus is adapted, the wafer carrier ring internal periphery including a portion which is sized and shaped to mate with the particular orientation edge discontinuity shape.

22. The replaceable component of claim 21 wherein the wafer carrier ring comprises an encircling ring portion, the internal periphery portion comprising an internal male projection extending inwardly from the encircling ring portion.

23. The replaceable component of claim 21 wherein the wafer carrier ring comprises an encircling ring portion, the internal periphery portion comprising an internal male projection extending inwardly from the encircling ring portion, the encircling ring porion and internal male projection having different respective axial thicknesses, the axial thickness of the male projection being less than the axial thickness of the encircling ring portion thereby forming an axial recess.

* * * * *

UNITED STATES PATENT AND TRADEMARK OFFICE

CERTIFICATE OF CORRECTION

PATENT NO. : 5,533,924

DATED : July 9, 1996

INVENTOR(S) : Hugh Stroupe; Sujit Sharan: Gurtej S. Sandhu

It is certified that error appears in the above-indentified patent and that said Letters Patent is hereby corrected as shown below:

ON THE TITLE PAGE:

Item

[54] POLISHING APPARATUS, A POLISHING WAFER CARRIER APPARATUS, A REPLACEABLE COMPONENT FOR A PARTICULAR POLISHING APPARATUS AND A PROCESS OF POLISHING WAFERS

Signed and Sealed this

Twenty-ninth Day of October 1996

*Attest:*

Bruce Lehman

BRUCE LEHMAN

*Attesting Officer*

*Commissioner of Patents and Trademarks*